US005155913A

United States Patent [19]

Marttiini

[11] Patent Number: 5,155,913

[45] Date of Patent: Oct. 20, 1992

[54] METHOD FOR MAKING A KNIFE AND A PRODUCT CORRESPONDING TO THE METHOD

[75] Inventor: Lauri Marttiini, Rovaniemi, Finland

[73] Assignee: J. Marttiinin Puukkotehdas Oy, Rovaniemi, Finland

[21] Appl. No.: 682,282

[22] Filed: Apr. 9, 1991

[30] Foreign Application Priority Data

Apr. 23, 1990 [FI] Finland ..... 902029

[51] Int. Cl.[5] ..... B25G 3/00

[52] U.S. Cl. ..... 30/342; 76/104.1; 76/106

[58] Field of Search ..... 30/340, 342-344; 76/104.1, 105, 106

[56] References Cited

U.S. PATENT DOCUMENTS 2,165,991 7/1939 West ..... 76/106

FOREIGN PATENT DOCUMENTS 0283445 3/1988 European Pat. Off. .
321879 3/1963 Sweden .
7610430-6 9/1976 Sweden .
1460448 3/1974 United Kingdom .

*Primary Examiner*—Douglas D. Watts
*Attorney, Agent, or Firm*—Lowe, Price, LeBlanc & Becker

[57] ABSTRACT

The invention relates to a knife and the method of making the same. The knife includes a blade, a blade's root end, an elongated intermediate piece and handle. The knife is made by connecting the blade including the root end, the intermediate piece and the handle to each other by gluing.

14 Claims, 1 Drawing Sheet

METHOD FOR MAKING A KNIFE AND A PRODUCT CORRESPONDING TO THE METHOD

The object of this invention is a method for making a knife and a knife made using this method.

Knives are generally made by inserting the root end of the knife blade into a bore in the handle piece. The root end of the knife blade is then riveted, or screwed from one end to keep it in place. In addition, a ferrule is placed at the blade-end of the handle to prevent the handle material from cracking easily and to keep the handle immobile. The handle may be of wood, rubber, etc.

The above mentioned method is extremely difficult to automate. The riveting stage requires the use of human labour and consequently the manufacturing costs can become high.

The method in accordance with the invention results in decisive improvements with regard to the above mentioned disadvantages. For the realization of these improvements, the method of making a knife in accordance with the invention is mainly characterized by what is presented in the characterization part of the patent claim 1 and the product is characterized by what is presented in the characterization part of the claim 5.

The invention's foremost advantage may be seen to be the automation of the making of the knife from start to finish. As a result of this automation, the costs of making the knife are reduced, thus making the knife competitive. The riveting stage can be omitted altogether and the insertion of the ferrule is not necessary because the advantages of the ferrule (e.g. support given to the handle) are achieved by gluing.

In the following, the invention is described by referring to the figures of which FIG. 1 is a schematic presentation of parts connected to the knife in accordance with the invention;

Figure 1:
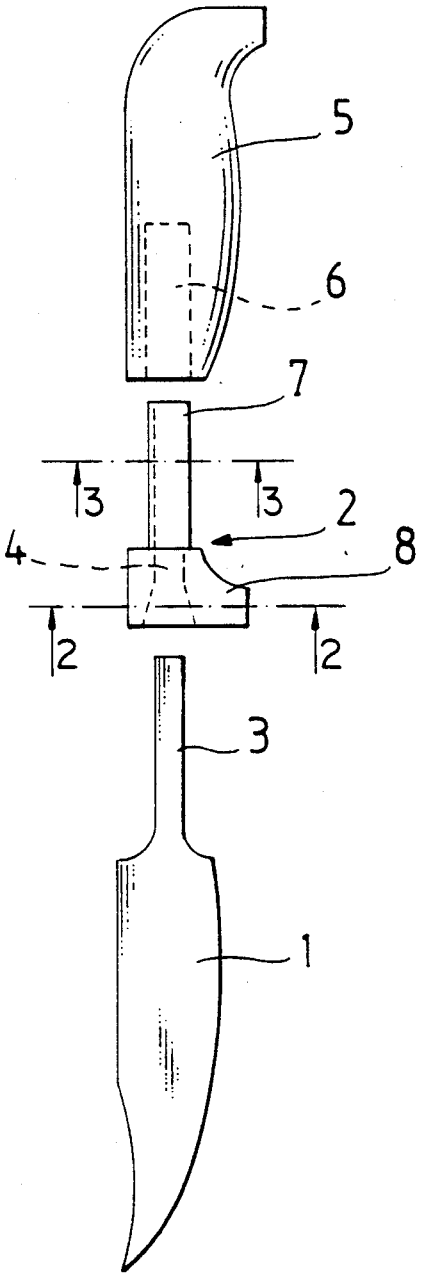
Figure 2:
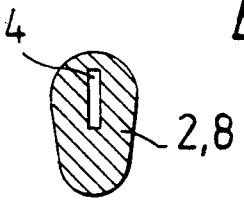
FIG. 2 depicts a sectional view on the line A—A in FIG. 1.
Figure 3:
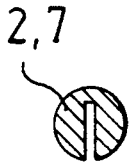
FIG. 3 depicts a sectional view on the line B—B in FIG. 1.

In FIG. 1, the blade is designated by reference number 1, the integral intermediate and ferrule piece by 2, the blade's root end by 3. In the method according to the invention, the blade 1 and the intermediate and ferrule part 2 are joined to one another by gluing by inserting the blade into the gap or groove 4 in piece 2. Thereafter, or concurrently with the gluing operation, the blade 1 and the intermediate and ferrule piece 2 are inserted into the longitudinal bore 6 in the middle of the handle 5. The diameter of bore 6 is close to or essentially the same as the external diameter of the elongated part 7 of the intermediate part 2. On the other hand, the cross-sections of the bore 6 and of the elongated part 7 of the intermediate piece need not be circular. The joints between the various parts are thus in this case formed by gluing. The method can be used for several kinds of blades having the root end of the shape so as to fit into the gap or groove 4.

Figure 4:
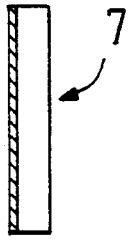
FIG. 4 depicts a split view of another kind of intermediate and/or ferrule piece connected to the knife in accordance with the invention.
Figure 5:
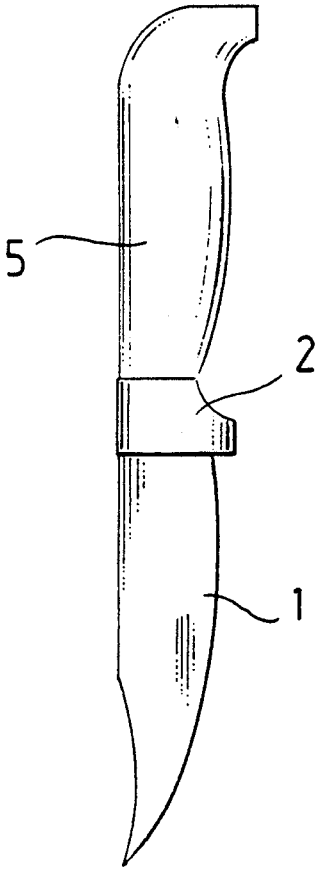
FIG. 5 depicts an assembled knife such as that depicted in FIG. 1.

FIG. 4 depicts an elongated intermediate piece of another shape. Such a piece can be used if the intention is to place a separate ferrule over the intermediate piece.

Although the use of a separate ferrule is avoided by the use of the preferred method.

The gap or groove 4 in the intermediate piece 2 is of such shape as will permit the blade's root end to be inserted into it and its shape is advantageously close to the cross section of the root end of the blade.

The intermediate piece 2 can be made to be of any form at the point of the hand protectors 8. The hand protectors 8 located between the handle 5 and the blade 1 can be made to be of various forms. The handle end of the intermediate piece can be provided with a circumferential recess into which that end of the handle which is close to blade can be inserted to provide support for the handle.

The intermediate piece 2 may be made of plastic, bronze, aluminum or corresponding materials. If the handle is made of rubber or some other corresponding material, then it is best to make the root end of the blade to extend almost the entire length of the handle in order to make the handle sufficiently stiff.

The order in which gluing is carried out may also vary; that is, first the intermediate piece is glued onto the handle and then the blade is glued onto the former. In actual fact, the most advantageous way is to first glue the intermediate piece onto the root end of the blade and then or simultaneously into the handle.

The hand protector may be given a surface treatment by nickel-plating in the case of aluminum or some other type of surface treatment depending on the properties of the material used in constructing the intermediate piece.

The root end of the blade can be perforated or have slits or other irregularities, allowing the adhesive to pass through the root end of the blade ensuring firmer adhesion. The root end of the blade can also be made to have an uneven surface as a means of improving the adhesive strength of the glue.

We have described the invention by referring to only one advantageous example of its implementation. The solutions presented in the above and in the accompanying figures are examples which are in no way intended to limit the invention.

Instead, all modifications within the framework of the inventive idea defined in the patent claim are, naturally, possible.

I claim:

1. A method for making a knife, said knife being composed of a blade having a root end, a handle with a bore and an intermediate piece integrally formed with a handguard, said method comprising the steps of:

applying an adhesive on the surfaces of the intermediate piece and the root end of the blade, connecting the integral intermediate piece and the root end of the blade to one another, and inserting the intermediate piece and root end of the blade into the bore in the handle.

2. A method for making a knife, the said knife being composed of a blade having a root end, a handle having a bore and an intermediate piece integrally formed with a handguard and having a groove, said method comprising the steps of:

applying an adhesive on the surfaces of the intermediate piece and the root end of the blade, inserting the intermediate piece onto the bore whereafter the blade's root end is inserted onto the groove.

3. A method as in claim 1, further comprising the step of gluing the bore of the handle.

4. A method as in claim 3, wherein the gluing of the bore is effected simultaneously with the step of applying adhesive to the blade's root end and the intermediate piece.

5. A knife comprising:

a blade having a root end, an integral intermediate piece and a handle having a bore, said integral intermediate piece containing a groove equal in length to the root end of the blade, said root end of said blade being inserted within said groove, the groove being formed as a narrow gap in said integral intermediate piece and being partially contained within said bore such that said root end of said blade fits to said bore and said groove.

6. A knife as in claim 5 wherein an outer surface of said intermediate piece within said bore essentially conforms with a surface of the said bore.

7. A knife as in claim 5 wherein an intermediate piece is made of a material selected from a group comprising plastic, bronze and aluminum.

8. A knife as in claim 5 wherein an root end of said blade is provided with surface irregularities.

9. A knife as in claim 5 wherein an integral intermediate piece includes an integral blade guard formed as a single piece.

10. A knife as in claim 8 wherein said surface irregularities are selected from a group including slits and perforations.

11. A knife comprising:

a blade having a root end, an intermediate piece integrally formed with a handguard and formed of plastic, and a handle having a bore, said root of said blade being arranged in a groove of said integral intermediate piece and attached thereto by adhesive, said integral intermediate piece being fitted into said bore of said handle and attached thereto by adhesive.

12. A knife as in claim 11 wherein said root end of said blade is provided with surface irregularities.

13. A knife as in claim 12 wherein said surface irregularities are selected from a group including slits and perforations.

14. A knife as in claim 12 wherein said handle is formed of a non-metallic substance.

* * * * *